United States Patent [19]

Kimmich

[11] Patent Number: 4,573,911

[45] Date of Patent: Mar. 4, 1986

[54] HEATER TREATER ECONOMIZER SYSTEM

[75] Inventor: Karl C. Kimmich, Bakersfield, Calif.

[73] Assignee: Mobil Oil Corporation, New York, N.Y.

[21] Appl. No.: 605,549

[22] Filed: Apr. 30, 1984

[51] Int. Cl.[4] ..... F27D 17/00; F28D 7/00; E21B 36/00; F27B 14/00

[52] U.S. Cl. ..... 432/179; 165/161; 166/302; 432/13

[58] Field of Search ..... 432/13, 179; 165/159, 165/160, 161; 166/266, 267, 302

[56] References Cited

U.S. PATENT DOCUMENTS 2,370,507 2/1945 Teichmann et al. ..... 166/266

2,411,097 11/1946 Kopp ..... 165/161

2,998,060 8/1961 Eckstrom ..... 165/159

4,319,635 3/1982 Jones ..... 166/266

*Primary Examiner*—John J. Camby

*Attorney, Agent, or Firm*—A. J. McKillop; Michael G. Gilman; Frank J. Kowalski

[57] ABSTRACT

An apparatus and method is disclosed for greatly increasing the efficiency of heater treater units, such as those used in heavy oil recovery, wherein exhaust air from the heater treater is circulated around incoming heavy oil lines from a freewater knockout unit to preheat the heavy oil reducing the required temperature increment provided by the heater treater to achieve a predetermined temperature for water/oil separation.

2 Claims, 5 Drawing Figures

HEATER TREATER ECONOMIZER SYSTEM

BACKGROUND OF THE INVENTION

The present invention pertains to tertiary oil recovery processing and, more particularly, to improving the efficiency of heater treaters used in moisture removal for heavy oil.

Presently, new oil wells are being drilled in remote areas and to greater depths. As such, new wells are becoming very expensive and the possibility of reworking old oil wells is increasingly attractive.

In the past, oil wells were drilled and when natural pressure ceased forcing oil out of formations, the well was considered as nonproducing. In eariler wells, natural pressure diminished quickly since the majority of these wells were shallow.

In most oil wells that are being reworked, the oil remaining is extremely heavy, having a density much closer to water than the oil originally produced. As a result, this oil may be suspended in water to the point where oil constitutes only thirty percent (30% ) of the solution. A good portion of this water is freewater and may be separated from an oil-water emulsion very easily by settling.

The process for heavy oil recovery is fairly simple and well known in the prior art; however, for the sake of clarity, a brief outline will be presented.

Heavy oil is forced from subsurface formations by the use of high pressure steam injection or by any one of many secondary or tertiary oil recovery methods currently in use in the art. In general, the heavy oil arrives at the surface in a slurry at approximately one hundred forty degrees Fahrenheit (140° F.). This slurry may be greater than seventy percent (70%) water, primarily from ground water, although steam injection does add slightly to the water content, although most subsurface oil is significantly less dense than water and easily separates from the subsurface water. However, heavy oil of the type obtained in secondary or tertiary recovery has a density much closer to that of water and is more difficult to separate.

As a result, chemical emulsion breakers, such as surfactants, are added to the water/oil mixture and the mixture is placed in a settling tank, sometimes referred to as the freewater knockout tank, for several hours. When the freewater has had an opportunity to settle, a water/oil emulsion along with the chemical coalescers are drawn off the top of the settling tank. Water is drained from the bottom of the tank.

The water/oil emulsion is piped to a heater treater where the emulsion is heated from approximately one hundred to one hundred fifty degrees (100°-150°) to between two hundred and two hundred fifty degrees Fahrenheit (200°-250° F.). The emulsion has been reduced from approximately seventy percent (70%) water as it arrives from subsurface formations to approximately thirty-five percent (35%) water from the freewater knockout tank. After the emulsion is removed from the heater treater, water constitutes only about three percent (3%) which is acceptable for transport to a facility for further refining.

The preshipment process comprising the freewater knockout tank along with the chemical surfactants and the heater treater add significant costs to the secondary and tertiary recovery of heavy oil.

SUMMARY OF THE INVENTION

The present invention discloses a method and apparatus for greatly increasing the efficiency of preshipment treatment facilities used in conjunction with secondary and tertiary heavy oil recovery systems. A pretreater is placed between a freewater knockout tank and a heater treater. The pretreater includes an opening for receiving the exhaust gas from the heater treater and a pipeline from the freewater knockout tank. The pipeline carries an oil/water emulsion through the preheater. The pipeline is run back and forth through the pretreater by having a plurality of one hundred eighty degree (180° ) bends. The conduit used in the pipeline is configured to have heat transfer fins its entire length. Baffles are provided within the pretreater housing to direct flow of the exhaust gas from the heater treater.

DESCRIPTION OF THE PREFERRED EMBODIMENT

Figure 1:
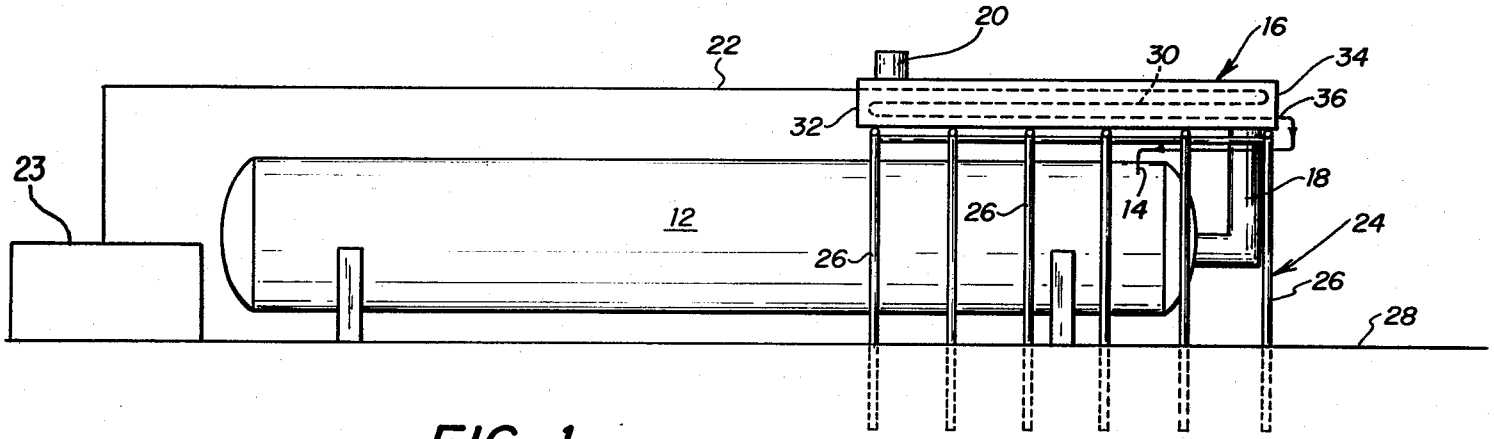
FIG. 1 is a side view of a heavy oil heater treater system.

Referring now to FIG. 1, a heavy oil heater treater 12 is illustrated as receiving an input 14 of an oil-water emulsion from preheater 16 and having an exhaust output 18 supplying preheater 16 which has its own exhaust port 20. Preheater 16 receives an input of an oil/-water emulsion 22 from a freewater knockout tank 23. In freewater knockout tank 23, chemical coalescers, such as surfactants, have been added to the water/oil mixture to aid in the water/oil separation. Preheater 16 is mounted on a pipe support structure 24 comprised of pipe units 26 partially buried in base support structure 28 which may be the ground, a gravel pit, a cement slab, or the like. Preheater 16 is illustrated as having a conduit 30 running from side 32 having input 22 to side 34 having output 36 in a serpentine manner.

Heater treater 12 may be of any type currently in use in the art having a gas powered heater (not shown) for raising the temperature level of a heavy oil/water emulsion, such as that produced in secondary and tertiary oil recovery methods. Normally, heater treater 12 will have a gas powered flame heating the heavy oil/water emulsion prior to emulsion being placed in a settling portion of the heater treater having a variety of filters used to urge coalescence of water suspended in the heavy oil/water emulsion.

Figure 2:
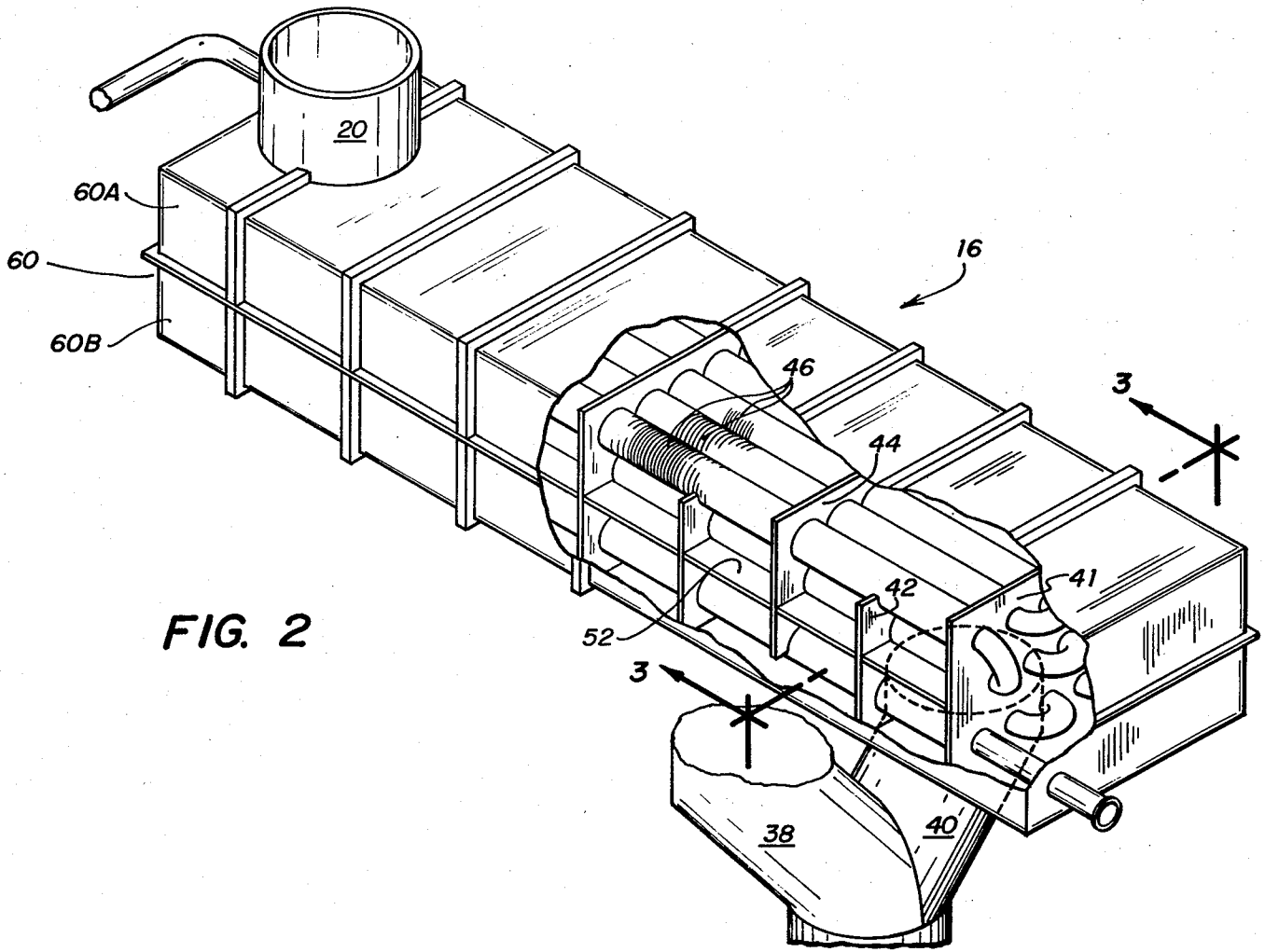
FIG. 2 is a partially cut-away isometric view of a pretreater.

Referring now to FIG. 2, a partially cut-away isometric view of pretreater 16 is illustrated as having three levels of conduit 30 weaving back and forth from end 32 to end 34 starting at inlet 22 of end 32 and ending at outlet 36 at end 34. The portions of conduit 30 are illustrated as having heat conducting fins throughout to assure substantial heat transfer between the input exhaust gas and conduit 30. Intake 18 is illustrated as a Y having an emergency exhaust arm 38 which is normally closed and intake section 40 which is normally open. Arm 38 is normally closed by a movable vent which may be rotated to block off arm 40 in the event of repairs being required by preheater 16. At such time, the vent (not shown) may be rotated to prevent flow of exhaust air through arm 40 and to allow all exhaust gas to flow through arm 38.

Under normal circumstances, arm 38 is blocked off and all exhaust air from heater treater 12 flows through preheater 16. The exhaust gas flowing through arm 40 may range from 600° to 800° F. Previously, this exhaust gas was being vented to the atmosphere resulting in tremendous amounts of waste heat. Through the use of the present invention, the exhaust air is provided to preheater 16 at end 34, circulates through preheater 16 and exhausts at exhaust port 20. The diameters of arm 38, arm 40, and exhaust port 20 are preferably all the same size to prevent any unnecessary back pressure to the burner of heater treater 20 while not allowing any expansion of the exhaust gas allowing it to cool and lose some of its heating properties. The diameters of arm 38, arm 40 and exhaust 20 are approximately 3-ft. However, any suitable diameter may be used as long as the general requirements as previously laid out are followed. The exhaust gas enters preheater 16 trhough arm 40 and heats the water/oil emulsion contained in the sections of pipe 30 between end plate 41 and baffle 42. The exhaust air travels toward baffle 44 which extends down from the top of preheater 16. As indicated previously, conduits 30 contain a plurality of heat transfer fins to assure heat transfer between the exhaust gas and the fluid contained within conduits 30.

Figure 3:
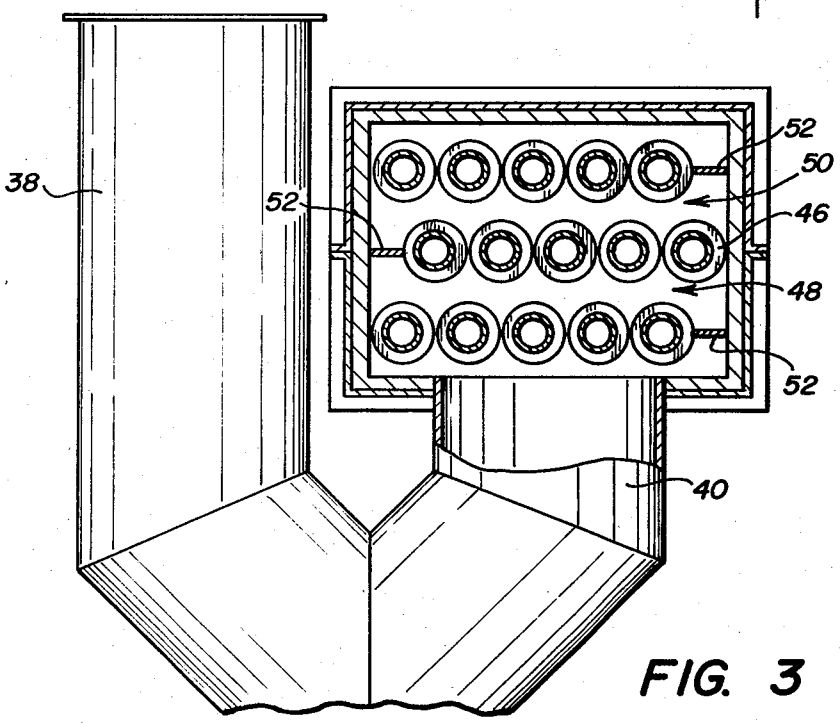
FIG. 3 is a sectional end view taken along lines 3—3 of FIG. 2.

Referring to FIG. 3, a sectional end view of FIG. 2 taken along lines 3—3 is illustrated as having arm 38 equal and parallel to arm 40 of the exhaust of heater treater 12. Conduits 30 are illustrated as comprising three layers, each layer of which heat conducting fins 46 of conduits 30 are in close proximity with each other having extremely slight clearances therebetween. It will be noted that there exists a space 48 and a space 50 between layers of conduits 30. At the end of each horizontal roll of conduits 30, a baffle 52 is illustrated. Baffles 52 extend the entire length of preheater 16 to provide even heating of conduits 30 and avoiding hot spots caused by exhaust gas flow concentrating in small open areas.

Figure 4:
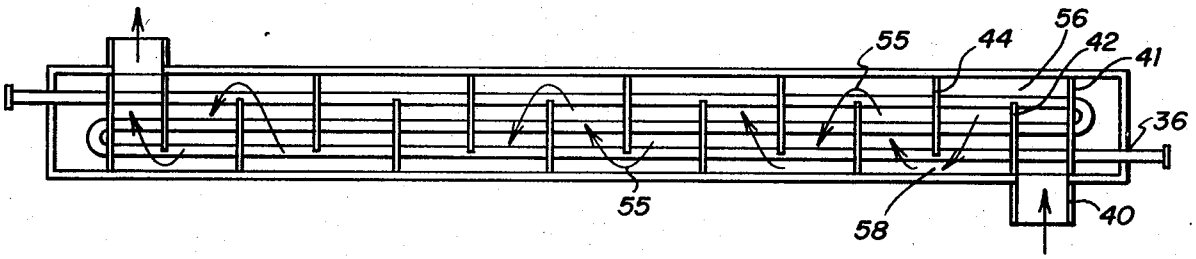
FIG. 4 is a side view of the apparatus of FIG. 1.

As illustrated in FIG. 4, exhaust gas enters through arm 40 rising along baffle 42 to an open area 56 above baffle 42. At this point, exhaust gas travels towards baffle 44 and is made to flow in a downward direction towards open area 58 below baffle 44. By using the construction illustrated in FIG. 5, the exhaust air rises and then is brought down to the bottom, allowed to rise again, brought down to the bottom again, and so on, throughout the length of preheater 16. In this manner, exhaust gas is circulated through preheater 16 in a serpentine manner til it exhausts at port 20 exhaust after heating the heavy oil/water emulsion flowing through conduits 30.

As indicated previously, exhaust gas enters port 40 through arm 18 at a temperature between 600° to 800° F. After circulating through preheater 16, the exhaust gas exiting port 20 is approximately 250° F. The heavy oil/water emulsion entering conduit 30 at input 22 is approximately 100°-150° F. The heavy oil/water emulsion exiting at output 36 has received an increase in temperature of approximately 30° F. Thus, preheater 16 has utilized previously wasted exhaust gas from heater treater 12 to raise the temperature of the heavy oil/water emulsion arriving at heater treater 12 through input 14 to reduce the heating requirements of heater treater 12 making it more efficient.

Figure 5:
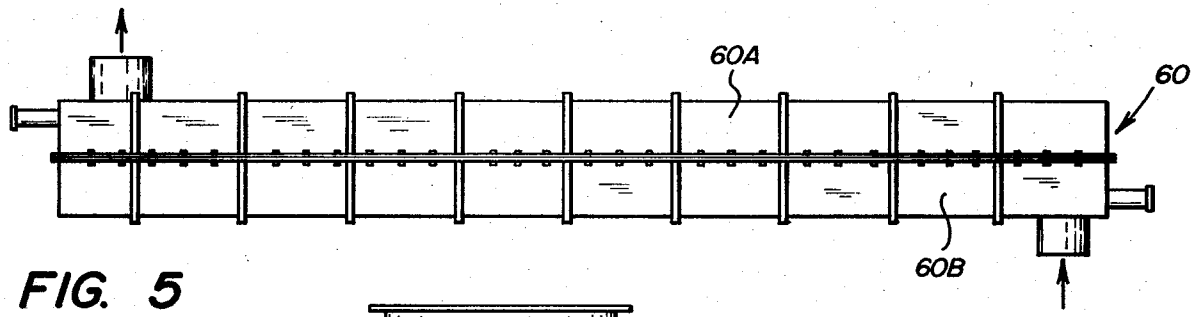
FIG. 5 is a simplified internal view of FIG. 2.

Referring now to FIG. 5, a side view of preheater 16 is illustrated. A housing 60 is comprised of two sections, 60*a* and 60*b*, a top half and a bottom half, respectively. Housing 60 is preferably made of steel covered with a fiberglass or asbestos insulation to prevent heat loss of exhaust gas from heater treater 12 entering through arm 18. Inlet 22 and outlet 36 are preferably steel pipe having a diameter of three to six inches and also having insulation (not shown) similar to that for housing 60.

The use of the present invention, preheater 16, permits the use of previously wasted exhaust gas from heater treater 12 having a temperature of 600° to 800° F. The exhaust gas is circulated through preheater 16 and forced over conduits carrying a heavy oil/water emulsion to raise the temperature of the emulsion approximately 30° F. prior to entering heater treater 12. By providing preheater 16 a reduced demand is placed on heater treater 12 permitting it to be operated using less fuel. In addition, the gentle rolling action of the heavy oil/water emulsion in preheater 16 provides additional agitation and mixing of the emulsion aiding in the coalescing of the water portion. The additional agitation permits the use of lesser quantities of the chemical coalescers, such as surfactants, prior to freewater knockout tank 23. Thus, the use of preheater 16 reduces the fuel requirement for heater treater 12 and the surfactant requirement for the chemicals added prior to freewater knockout settling tank 23. The use of preheater 16 reduces the cost and thus improves the efficiency of the pretreatment system used in conjunction with secondary and tertiary heavy oil recovery systems.

While the present invention has been illustrated by way of preferred embodiment, it is to be understood that it is not limited thereto but only by the scope of the following claims.

What is claimed is:

1. In combination:

a heater treater for preshipment processing of heavy oil having an inlet for receiving an oil/water emulsion and a combustion heater for heating said oil/water emulsion and an outlet for supplying processed heavy oil for shipment;

a freewater knockout tank having an inlet for receiving an oil/water slurry and an outlet for providing an oil/water emulsion; and a preheater placed between said outlet of said freewater knockout tank and said inlet of said heater treater, said preheater having a housing with an opening for receiving exhaust gas from said combustion heater of said heater treater, a plurality of conduit sections running the length of said housing arranged in horizontal rows, said conduit sections connected at opposite ends to provide a continuous conduit extending from outlet of said freewater knockout tank to said inlet of said heater treater and having heat conductive fins for heat transfer between said exhaust gas and said conduit sections, said housing having vertical baffles for directing said exhaust gas alternatively up and down in a serpentine manner and horizontal baffles for sealing openings between said horizontal rows on a side of said housing, said housing having an insulating cover to prevent heat loss to outside ambience.

2. An improvement for increasing the energy efficiency of a heater treater for preshipment processing of heavy oil having an inlet for receiving an oil/water emulsion from a freewater knockout tank having an inlet for receiving an oil/water slurry and an outlet for providing an oil/water emulsion and a combustion heater for heating said oil/water emulsion and an outlet for supplying processed heavy oil for shipment comprising:

a preheater placed between the outlet of the freewater knockout tank and the inlet of said heater treater, said preheater having a housing with an opening for receiving exhaust gas from said combustion heater of said heater treater, a plurality of conduit sections running the length of said housing arranged in horizontal rows, said conduit sections connected at opposite ends to provide a continuous conduit and having heat conductive fins for heat transfer between said exhaust gas and said conduit sections, said housing having vertical baffles for directing said exhaust gas alternatively up and down in a serpentine manner and horizontal baffles for sealing openings between said horizontal rows on a side of said housing, said housing having an insulating cover to prevent heat loss to outside ambience.

* * * * *